US006318700B1

(12) United States Patent
Cliff

(10) Patent No.: US 6,318,700 B1
(45) **Date of Patent: *Nov. 20, 2001**

(54) ANTI-FROST CONCRETE MOULD

(76) Inventor: Brent Cliff, 28 Amberwood Lane, Fredericton, N.B. (CA), E3C 1L7

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/879,430

(22) Filed: Jun. 20, 1997

(30) Foreign Application Priority Data

Jun. 21, 1996 (CA) ..... 2179701

(51) Int. Cl.[7] ..... E04C 3/34

(52) U.S. Cl. ..... 249/13; 249/48; 249/51; 249/53 R; 249/134; 249/143

(58) Field of Search ..... 249/48, 49, 51, 249/134, 143, 53 R, 53 M, 13

(56) References Cited

U.S. PATENT DOCUMENTS

| | | | | |
|---|---|---|---|---|
| 883,569 | * | 3/1908 | Rodgers | 249/51 |
| 975,135 | * | 11/1910 | Kelsey et al. | 249/51 |
| 1,119,711 | * | 12/1914 | McGee | 249/51 |
| 1,454,434 | * | 5/1923 | Gardner | 249/48 |
| 1,627,754 | * | 5/1927 | Townsend | 249/51 |
| 3,162,922 | * | 12/1964 | Alziari | 249/48 |
| 3,166,871 | * | 1/1965 | Simison | 249/51 |
| 3,561,175 | | 2/1971 | Best et al. . | |
| 3,588,027 | | 6/1971 | Bowden | 249/48 |
| 3,682,434 | | 8/1972 | Boenig | 249/48 |
| 3,839,518 | | 10/1974 | Rubens et al. . | |
| 4,019,301 | | 4/1977 | Fox . | |
| 4,673,157 | * | 6/1987 | Wells | 249/51 |
| 4,702,057 | | 10/1987 | Phillips . | |
| 5,271,203 | | 12/1993 | Nagle . | |
| 5,328,142 | | 7/1994 | Weekers | 249/48 |
| 5,457,929 | | 10/1995 | Kim . | |

FOREIGN PATENT DOCUMENTS

| | | | | |
|---|---|---|---|---|
| 920380 | | 2/1973 | (CA) . | |
| 1284727 | | 1/1987 | (CA) . | |
| 1244669 | | 11/1988 | (CA) . | |
| 2145512 | | 9/1993 | (CA) . | |
| 1510198 | * | 5/1978 | (GB) | 249/53 R |

OTHER PUBLICATIONS

Advertising brochure for "Big Foot System" by F&S Manufacturing Inc. (unknown publication date).

* cited by examiner

*Primary Examiner*—Nam Nguyen
*Assistant Examiner*—Joseph Leyson
(74) *Attorney, Agent, or Firm*—Simpson, Simpson & Snyder, PLLC

(57) ABSTRACT

An anti-frost concrete mold having an upper frustoconical portion, a transitional shoulder portion and a lower drum portion. The top portion of the mold is adjustable in height. The mold is fabricated simply by molding it over a die. The mold is fabricated from various suitable recycled materials bound with a binding agent.

16 Claims, 7 Drawing Sheets

PRIOR ART

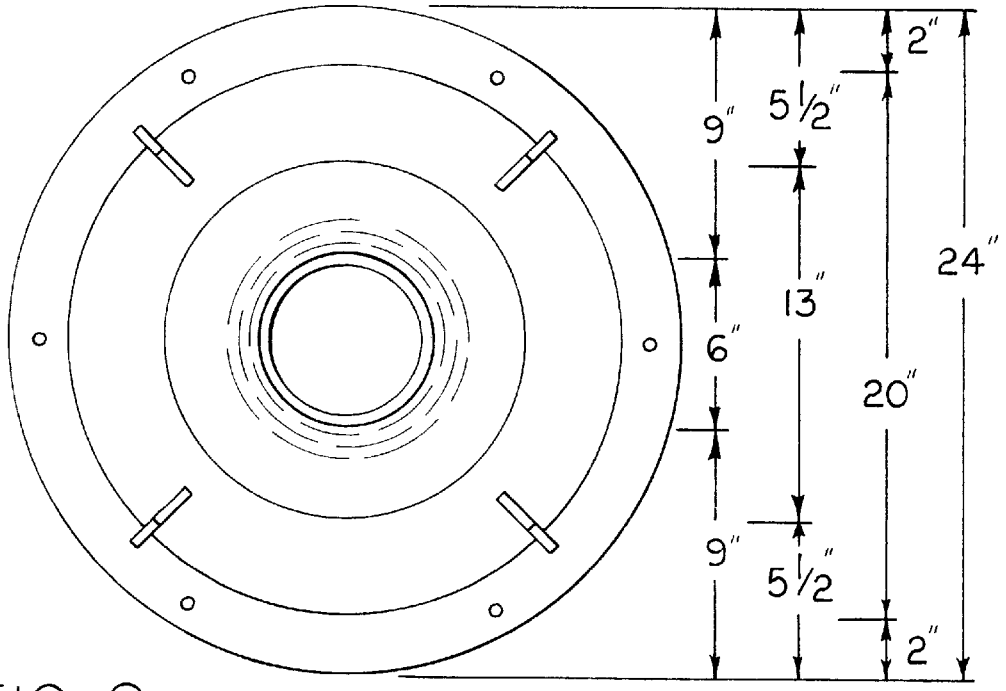
FIG. 8
FIG. 9
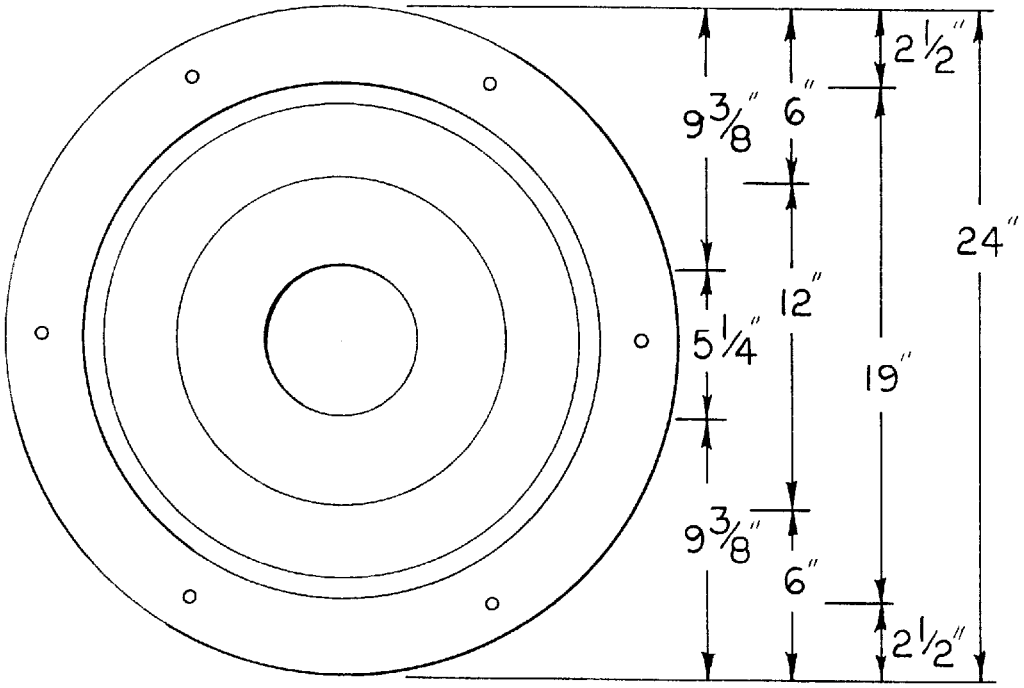

ANTI-FROST CONCRETE MOULD

FIELD OF THE INVENTION

The present invention relates to an anti-frost concrete mould.

BACKGROUND OF THE INVENTION

The use of forms, casings, moulds and shells is well known in the construction of cast-in-place concrete footings, piers and piles. These footings, piers and piles are used to transfer the loads of buildings, bridges, decks, porches, raised walkways, ramps, mini-home supports, highway sign posts and add-ons of existing structures to the underlying supporting soil. The concrete of a cast-in-place pile or footing is cast inside a mould that usually consists of a tin metal, plastic or paper shell left in the ground. The mould is usually so thin that its strength is disregarded in evaluating the structural capacity of the pile or footing. However, the mould must have adequate strength to resist collapse under the pressure from the surrounding backfill before it is filled with concrete. Similarly, if the mould is filled with concrete without the support of backfill, the mould must have sufficient strength to resist bursting pressures.

In northern latitudes, such as those which encompass Canada, northern Europe and the northern portions of the United States, soils, and particularly fine grained water saturated soils, are susceptible to the formation of ice lenses and frost heave. These phenomena can greatly diminish the stability and integrity of structures embedded in such soils. Therefore, footings are placed at a depth of not less than the depth of normal frost penetration. This prevents damage to the footing from the swelling and shrinkage of the surrounding soil caused by freeze-thaw cycles or displacement from frost heaving. However, while placing the footing below the depth of frost penetration will protect the footing from the effects of frost action, the pier that transfers the loads from the supported structure to the footing remains above the frost line and therefore remains vulnerable to frost and ice action.

The mechanisms of frost heave and frost action are well known to persons skilled in the art. The main phenomenon of concern to the construction industry is the displacement, laterally and vertically, of foundation members due to loads placed upon them from frost action. Where surrounding soil is frozen to a pier connecting a supported structure to a supporting footing, movement of the soil frozen to the pier will displace the pier. This will diminish the stability of the footing and structure to which it is attached no matter the depth of the footing below the frost line. In northern climates, a pier must be of a significant length to connect a footing placed below the frost line to the structure on the surface. Most of the entire length of the pier embedded in frost susceptible soil will be vulnerable to frost action.

Many examples of concrete moulds are known. However, none of these addresses the problem of being able to resist upward displacement due to frost heave in the surrounding soil. The problem is particularly acute in climates where the footing must be placed at a significant depth below the surface to remain unaffected by frost. One example of the known art is described in U.S. Pat. No. 5,271,203 issued to Nagle on Dec. 21, 1993 and entitled "Support Form For A Setable Material". Nagle recognizes the problems associated with frost heave and compares the advantages of his invention over conventional thin-walled constant diameter moulds, such as the SONATUBE™, which he states are vulnerable to tipping and leaning due to lateral forces caused by frost heave in surrounding soil. While the Nagle invention relies upon its conical shape to resist frost heave, it possesses longitudinal ribs that could permit water to collect and freeze therein thus allowing localized frost action to act detrimentally upon the mould.

Furthermore, the dimensions of the Nagle invention, specifically its height to width ratio, approaches unity. Therefore, for deep frost line applications, where the mould would have to be embedded deeply into the soil and remain connected to the above surface supported structure, the resulting mould of the Nagle design would have to be very large. This would result in greater expense and the mould would require a significant volume of setable material to fill it.

An additional disadvantage of the Nagle invention is that it is of a fixed height and cannot be adjusted at the work site to adapt to the variable depth of excavations. Furthermore, the Nagle invention does not possess anchoring means to prevent the mould from shifting as the concrete is poured. Furthermore, if the Nagle invention is left exposed to the elements for several days before the setable material is poured, there are no means to anchor the Nagle invention to the ground to prevent wind and rain forces from displacing the Nagle invention.

SUMMARY OF THE INVENTION

It is an object of the present invention to provide an improved concrete mould that resists the detrimental action of frost heave.

In accordance with an aspect of the present invention there is provided an anti-frost concrete mould that resists the adhesion of frost, ice and frozen soils. The mould generally resembles a cone and comprises an upper frustoconical portion coaxially aligned with a lower drum portion whose outer surface extends outwardly and downwardly from a transitional shoulder. The shoulder connects the upper portion of the mould with the lower portion of the mould. The mould has opposed top and bottom ends and a continuous and smooth exterior surface. The mould is manufactured from recycled material bound with a binding agent. The bottom end of the mould has an integral anchor flange extending horizontally from it. The anchor flange is apertured at regular intervals for holding anchoring means in the form of pins, nails, dowels and other hold-down devices. The mould is sufficiently resilient and rigid to withstand the pressure from surrounding soil attempting to collapse the mould inwardly. The mould is further able to withstand fluid pressures from the fluid setable material contained therein attempting to burst the mould outwardly. The mould has a smooth outer and inner surface.

In a further aspect of the present invention there is provided an inexpensive and simple method of manufacturing the mould comprising the steps of: determining the appropriate dimensions of the mould to suit the intended purpose; producing a die in obedience to the desired dimensions of the mould; covering said die with a non-stick fabric; applying a plurality of layers of a mixture of binding agent and recycled material to the fabric covering the die until a mould of the desired thickness is formed; finishing the mould with a smooth surface of binding agent.

In a further embodiment of the invention, the mould may be manufactured using injection moulding techniques.

In yet another aspect of the present invention it is contemplated that the mould be manufactured from resilient, rigid and light weight recycled materials, such as, wood, plastic, cloths, fabrics or other synthetic or natural materials bound together using a binding agent. The outer surface of the mould will have a smooth surface with frost and ice adhesion resistant properties.

Yet another aspect of the present invention contemplates a method of using the mould comprising the steps of: excavating a cavity in the earth; placing a mould of desired dimensions into the cavity; anchoring the mould through the anchoring flange using anchoring means; adjusting the height of the mould as necessary by cutting away excess mould along the grooves at the top end of the mould; backfilling the excavation around the mould; if necessary, capping the open top end of the mould with capping means to prevent water from collecting within the mould; when convenient, filling the mould with a setable material, generally concrete; insert the desired structure to be supported by the concrete before setting or alternatively allow the concrete to set and then affix the concrete mould to the structure to be supported; and, leaving the mould in place.

Advantages of the present invention are that the mould can be used in locations where there is a deep penetration of frost and a frequent cycle of soil freezing and thawing without being displaced. The mould is also easy and inexpensive to manufacture being made from recycled materials.

BRIEF DESCRIPTION OF DRAWINGS

The present invention will be further understood from the following description with references to the drawings in which:

FIG. 8 illustrates a top view of one embodiment of the present invention showing possible dimensions to suit one application of the present invention.

FIG. 9 illustrates a bottom view of one embodiment of the present invention showing possible dimensions to suit one application of the present invention.

DETAILED DESCRIPTION

Figure 1:
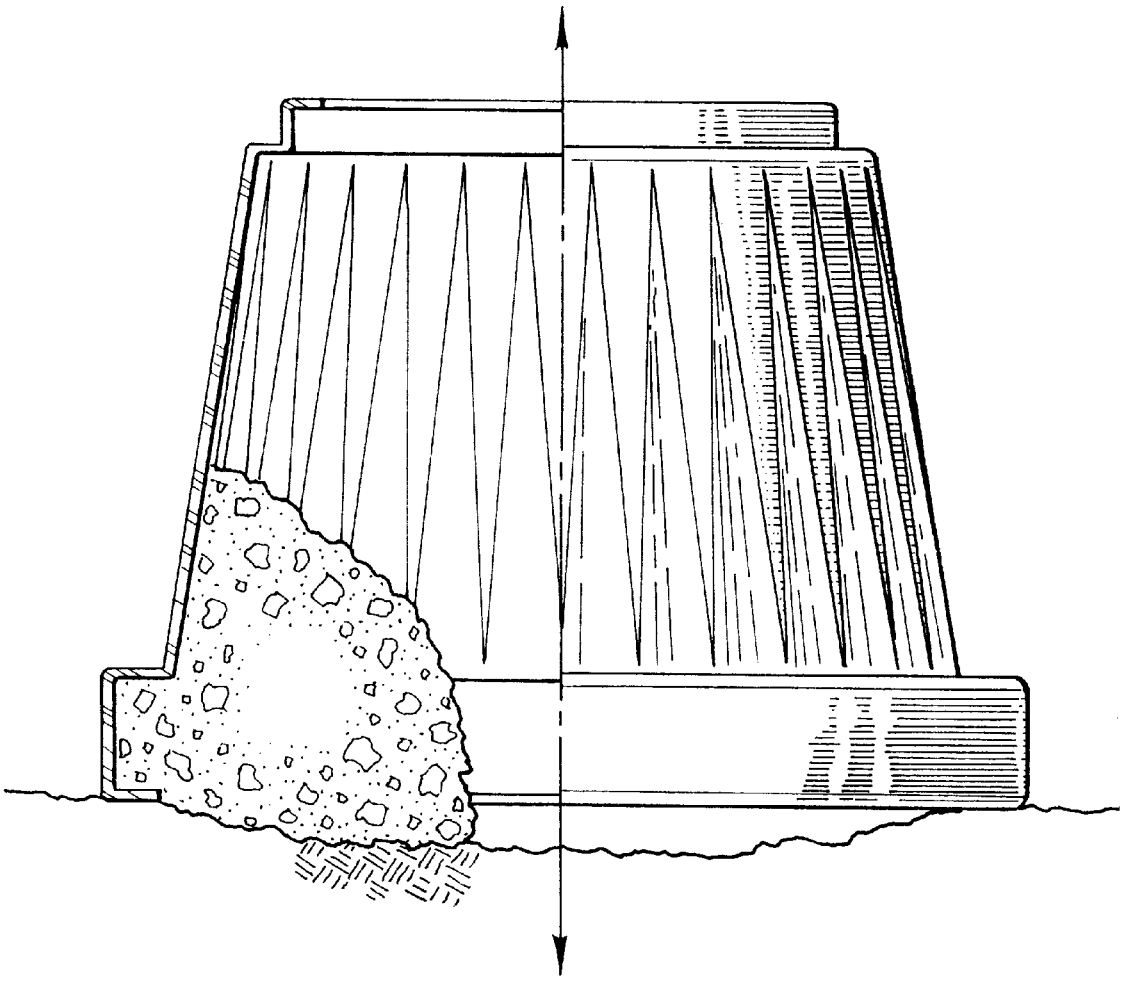
FIG. 1 illustrates an example of the known art.

An example of a known concrete mould is shown in FIG. 1 and has been previously discussed.

Figure 2:
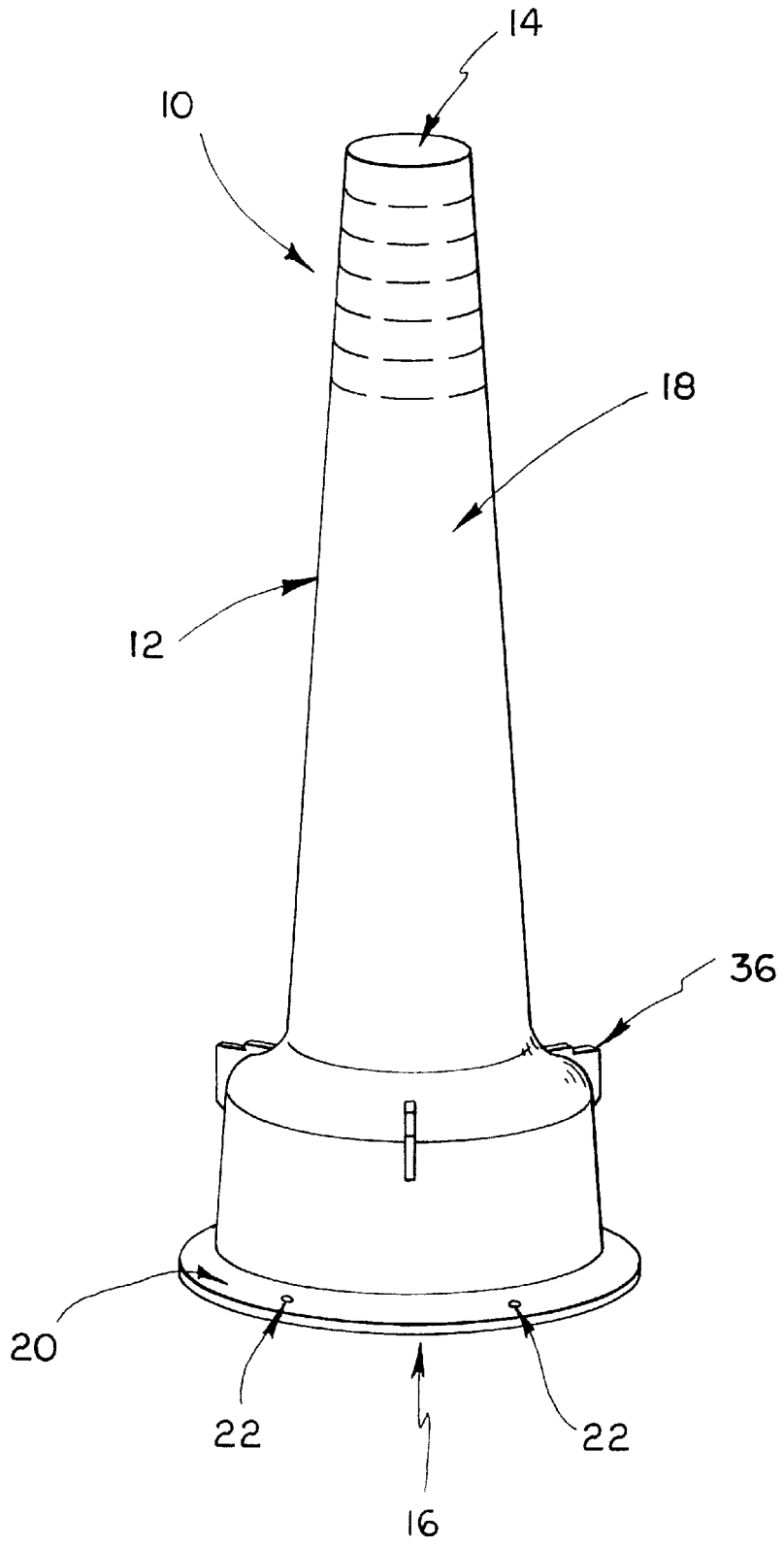
FIG. 2 illustrates in perspective view one embodiment of the present invention.

FIG. 2 shows one embodiment of the present invention (10) comprising a hollow rigid elongated mould (12) generally resembling a cone. The mould has opposed top (14) and bottom (16) ends. In a preferred embodiment of the present invention the diameter of the top end is approximately 33% the diameter of the bottom end. The mould (12) has a continuous and smooth exterior surface (18). The mould is manufactured from material which resists the adhesion of frost, ice and frozen soils.

The bottom end of the mould has an integral anchor flange (20) perforated at regular intervals (22) to hold anchoring means.

Figure 3:
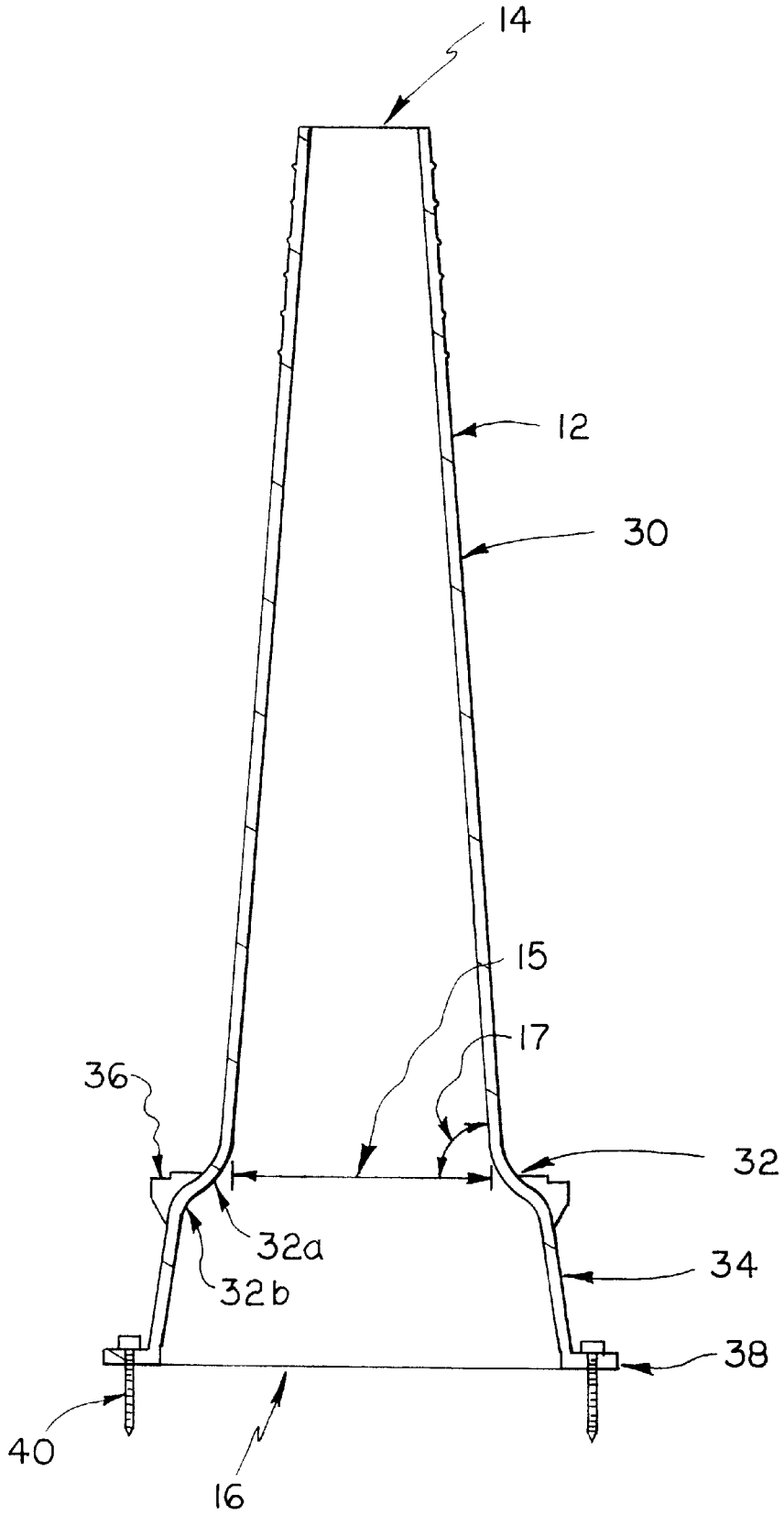
FIG. 3 illustrates in sectional side view another embodiment of the present invention.

FIG. 3 shows another embodiment of the present invention in sectional side view in which the mould (12) comprises an upper frustoconical portion (30) coaxially aligned with a lower drum portion (34) whose outer surface extends outwardly and downwardly from a transitional shoulder (32) connecting the upper portion with the lower portion of the mould. In a preferred embodiment of the present invention, the diameter of the top opening (14) of the conical upper portion (30) is approximately 50% of the diameter of the bottom opening (15) of the upper conical portion (30). In a preferred embodiment of the present invention, the height of the upper conical portion (30) represents approximately 85% of the total height of the mould. Therefore, the upper conical portion (30) of the mould (12) acts as a pier connecting the supported structure to the supporting soil. In a preferred embodiment of the present invention, the interior angle (17) of the wall of the upper conical portion (30) of the mould (12) is approximately 85 degrees from a horizontal plane bisecting the bottom end (15) of conical portion (30). In a preferred embodiment of the present invention, the thickness of the mould (12) at the top end (14) of the upper conical portion (30) is approximately ⅜ inches and the thickness at the bottom end (15) of the upper conical portion (30) is approximately ½ inches.

Attached and integral to the bottom (15) of the upper conical portion (30) is transitional shoulder (32). Transitional shoulder (32) is also attached and integral to the upper end of the drum portion (34) of the mould (12). As seen from inside the mould, and from the top to the bottom of the transitional shoulder, transitional shoulder (32) comprises a first convex **(32*a*) surface and a second concave surface (32*b*) joined together. In a preferred embodiment of the present invention, each surface (32*a* & 32*b*) has a radius of approximately 1 inch. The resulting effect of the transitional shoulder (32) is to expand the diameter of the mould (12) by approximately 50% from the lower end of the conical portion (30) to the lower end of the drum portion (34). In a preferred embodiment of the present invention, the height of the transitional shoulder (32) is approximately 4% of the total height of the mould (12)**.

Stacking supports (36) are attached to the mould (12) at the shoulder (32) and are spaced equidistantly about the circumference of the mould. In a preferred embodiment of the present invention, there are four stacking supports equidistantly spaced about the circumference of the mould, approximately ½ inches wide by 1 ¼ inches long by approximately 3½ inches in height.

The lower drum portion (34) of the mould (12) extends downwardly and outwardly from the transitional shoulder (32). In a preferred embodiment of the present invention, the interior angle formed by the wall of the drum portion to a horizontal plane bisecting the lower drum portion at (16) is approximately 85 degrees so that the walls of the upper conical portion (30) and the walls of the lower drum portion (34) are substantially parallel. In a preferred embodiment of the present invention, the height of the drum portion (34) is approximately 10% of the total height of the mould (12). The diameter of the mould at the bottom end (16) of the drum portion is approximately 300% of the diameter of the top portion (14).

The anchor flange (38) is attached and integral to the bottom of the drum portion (34) of mould (12). The anchor flange (38) is sufficiently dimensioned to withstand potential shearing forces which may be developed between the anchor flange and the anchor means (40) fixing the mould to the soil. The anchor means may comprise nails, hold-downs, pins, bolts, dowels and similar devices inserted through the apertures in the anchor flange which anchor means are of sufficient length to fix the mould in the desired location. In a preferred embodiment of the present invention, the outer diameter of the anchor flange is approximately 125% the inner diameter of the lower end of the drum portion (34) and the thickness of the mould from the transitional shoulder to the tip of the anchor flange is approximately ½ inches.

While FIG. 3 shows an embodiment of the present invention with the bottom end (16) of mould (12) open so that the setable material is in direct contact with the supporting soil, it may also be closed. Whether open or closed, the diameter of the lower end (16) of the drum portion (34) is adequately large enough to transfer the loads from the supported structure to the underlying soil.

As shown in FIG. 3, the present invention must be sufficiently rigid and resilient to resist crushing pressure from surrounding soil and bursting pressure from the setable material contained therein before setting.

Figure 4:
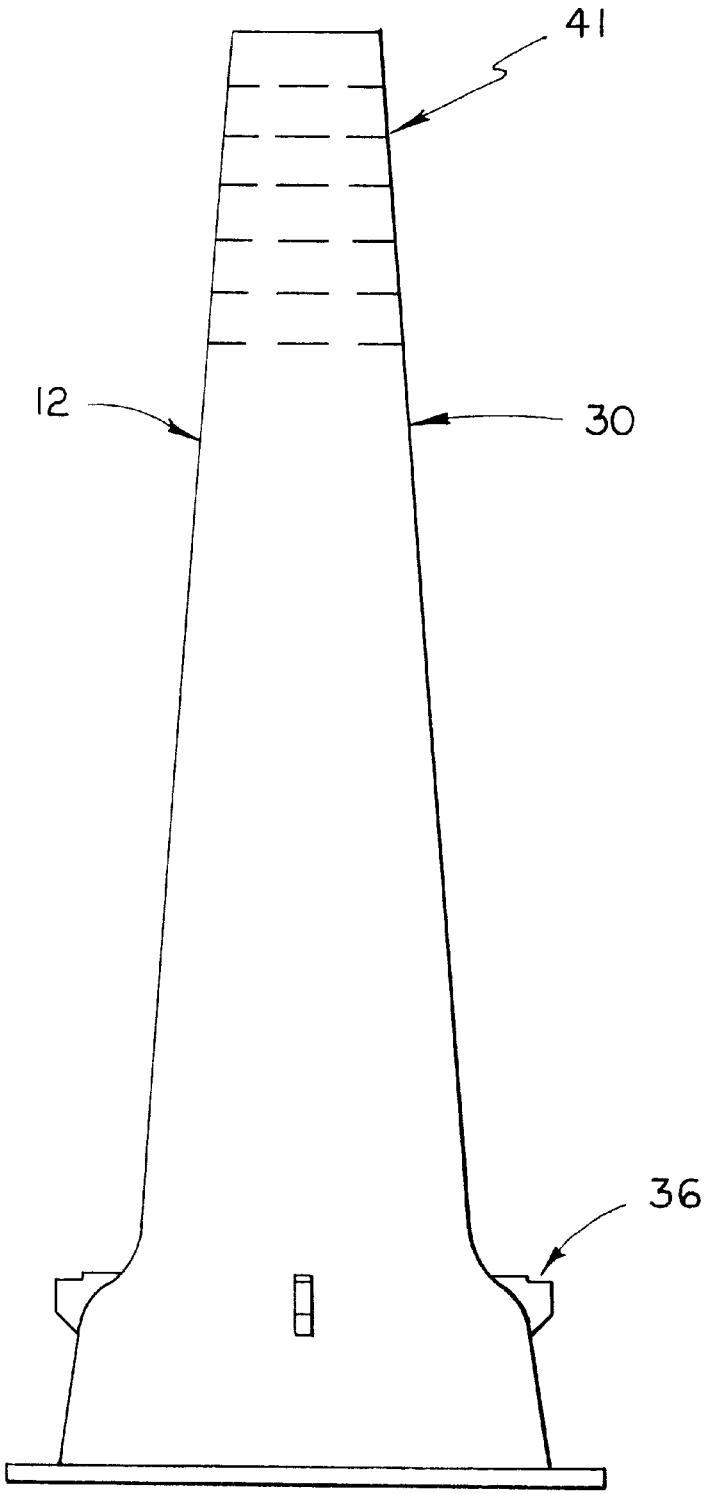
FIG. 4 illustrates a side-view of one embodiment of the present invention.

Referring to FIG. 4, one embodiment of the present invention shows the plurality of spaced concentric rings (41) located at the top of the frustoconical portion (30) of mould (12) which circumscribe the outer surface of the cone. In the preferred embodiment of the present invention, these rings are spaced at two inch intervals from the top of the cone down to approximately 18 inches from the top of the cone. A worker uses these rings as a guide to remove excess material from the top of the cone. In a preferred embodiment of the invention these rings comprise a series of raised dots approximately ⅛ inches in height.

Figure 5:
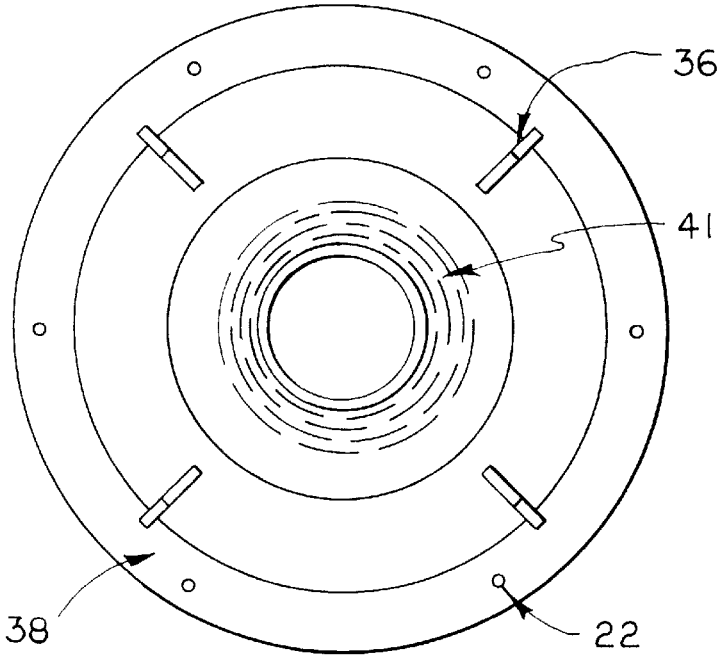
FIG. 5 illustrates a top view of one embodiment of the present invention.

FIG. 5 shows a top view of one embodiment of the present invention illustrating the spacial relationship between the top of the cone (14); the concentric rings (41); the stacking shoulders (36); and the anchor flange (38). Also shown is a plurality of holes (22) through which anchoring means are placed.

Figure 6:
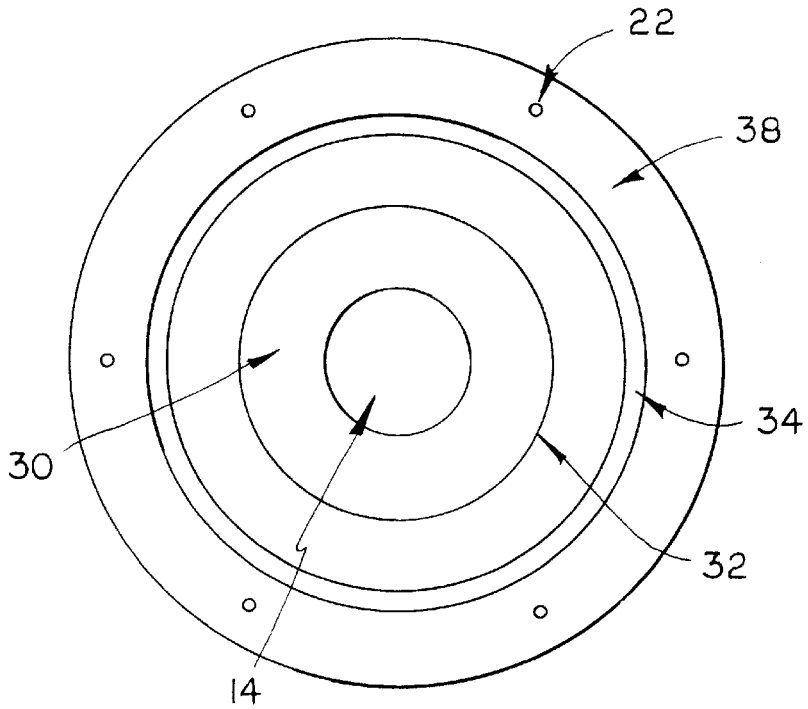
FIG. 6 illustrates a bottom view of one embodiment of the present invention.

FIG. 6 shows a bottom view of one embodiment of the present invention illustrating the spacial relationship between the anchor flange (38); the holes through which the anchor means are placed (22); the drum portion of the mould (34); the transitional shoulder (32); between the drum portion (34); and, the frustoconical cone portion (30) of the mould (12). While FIG. 6 shows an embodiment of the present invention with an open bottom, it is contemplated that the bottom may be sealed.

Figure 7:
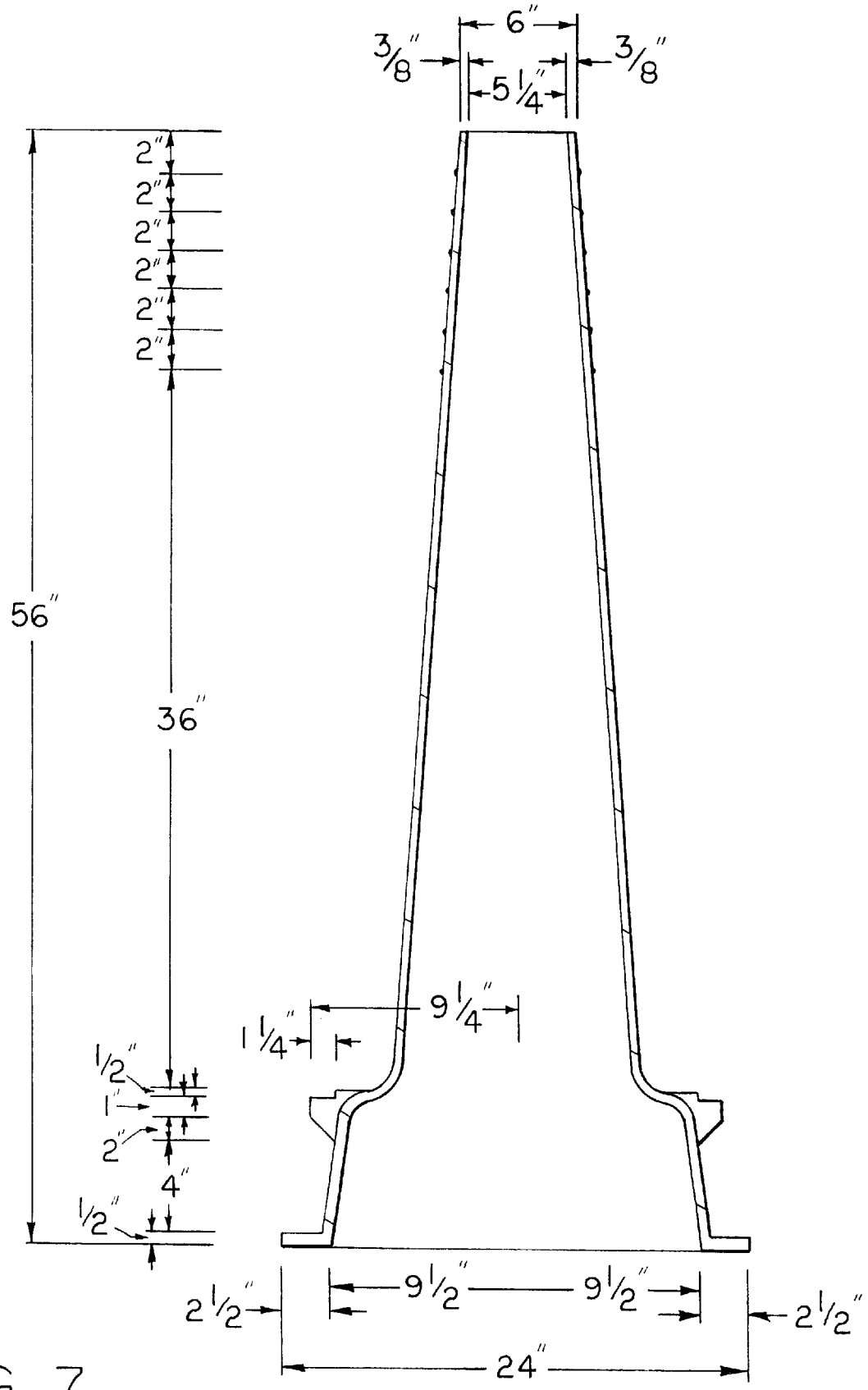
FIG. 7 illustrates a sectional side view of one embodiment of the present invention showing possible dimensions to suit one application of the present invention.

Although it is understood by a person skilled in the art that the size and dimensions of the mould can be varied to suit the intended purpose, FIGS. 7, 8 and 9 show examples of the dimensions of embodiments of the present invention to suit a specific application.

The present invention contemplates that the mould is to be manufactured from resilient, rigid and light weight recycled materials, such as, wood, plastic, cloths, fabrics or other synthetic or natural materials bound together using a binding agent. The outer surface of the mould will have a smooth surface with frost and ice adhesion resistant properties.

Numerous modifications, variations, and adaptations may be made to the particular embodiments of the invention described above without departing from the scope of the invention, which is defined in the claims.

The embodiments of the invention in which an exclusive property or privilege is claimed are defined as follows:

1. A unitary, hollow, cone-shaped anti-frost concrete combination pier and footing concrete mould having a height, H, comprising:

an upper frustoconical pier portion, said pier portion having continuous and smooth inner and outer surfaces to resist frost, ice and frozen soil adhesion thereto, said pier portion having a height which is approximately 85% of the height H of the mould;

a transitional shoulder portion integral with said pier portion comprising an upper convex portion and a lower concave portion, said concave and convex portions having smooth, continuous, curved inner and outer surfaces to resist frost, ice and frozen soil adhesion thereto;

a lower frustoconical footing portion integral with said transitional shoulder portion, said footing portion coaxially aligned with said upper pier portion and joined thereto by said transitional shoulder portion, said integral footing portion having a single frustoconically shaped wall which extends outwardly and downwardly from said integral shoulder portion, said lower footing portion having smooth, continuous inner and outer surfaces to resist frost, ice and frozen soil adhesion thereto;

anchor means for securing said mould to supporting soil; and, an integral anchor flange emanating outwardly from said lower footing portion, said anchor flange having a plurality of apertures therein to facilitate said anchor means, wherein said mould is constructed from resilient recycled materials bound together with a binding agent, said recycled materials being resistant to frost, ice and frozen soil adhesion.

2. An anti-frost concrete mould as recited in claim 1 wherein a top end of said pier portion of said mould is open to permit settable material to be poured therein.

3. An anti-frost concrete mould as recited in claim 2 wherein a bottom end of said footing portion of said mould is closed and sealed.

4. An anti-frost concrete mould as claimed in claim 1 wherein a bottom end of said mould is open to permit settable material placed within said mould to be in contact with underlying soil.

5. An anti-frost concrete mould as claimed in claim 4 wherein said mould is sufficiently rigid to withstand the pressure from surrounding soil and resist collapsing inwardly.

6. An anti-frost concrete mould as claimed in claim 5 wherein said mould is sufficiently rigid to withstand fluid pressures from the fluid settable material contained therein and to resist bursting outwardly.

7. An anti-frost concrete mould as claimed in claim 6 wherein said footing portion is sufficiently large in diameter to adequately transfer structural load from a structure being supported by said mould to underlying supporting soil.

8. An anti-frost concrete mould as claimed in claim 7 wherein the anchor flange is symmetrically apertured at regular intervals such that each aperture has an adjacent aperture directly across the diameter of the cone-shaped anti-frost concrete mould.

9. An anti-frost concrete mould as claimed in claim 8 wherein said anchor flange is of sufficient thickness and width to resist shear forces which may be developed between said anchor flange and said anchor means.

10. An anti-frost concrete mould as claimed in claim 9 wherein the anchor means are selected from the group consisting of nails, hold-downs, pins, bolts, and dowels.

11. An anti-frost concrete mould as claimed in claim 10 wherein a top portion of said frustoconical portion includes a plurality of concentric rings circumscribing an external surface of said frustoconical portion of the mould spaced at regular intervals.

12. An anti-frost concrete mould as claimed in claim 11 wherein said concentric rings are parallel to one another and comprise a series of raised dots and provide a guiding means for easily removing sections of the mould to adjust its height while maintaining structural integrity of the mould.

13. An anti-frost concrete mould as claimed in claim 12 further comprising stacking means secured to said mould to facilitate stacking one mould upon another for storage and transportation purposes without compromising the structural integrity of the moulds.

14. An anti-frost concrete mould as claimed in claim 13 wherein said mould is manufactured from one or more resilient, rigid and light weight material(s).

15. An anti-frost concrete mould as claimed in claim 14 wherein said materials are recycled materials selected from the group consisting of wood, plastic, cloths, fabrics and other synthetic and natural materials.

16. An anti-frost concrete mould as claimed in claim 1 wherein said mould is provided with a capping means to prevent precipitation from entering the mould when exposed to the elements.

* * * * *